United States Patent [19]

Wooden

[11] 4,226,419

[45] Oct. 7, 1980

[54] STRATEGY GAME

[76] Inventor: Neal R. Wooden, 515 Paumakua Pl., Kailua, Hi. 96734

[21] Appl. No.: 939,823

[22] Filed: Sep. 5, 1978

[51] Int. Cl.[2] ..... A63F 3/02

[52] U.S. Cl. ..... 273/260; 273/288

[58] Field of Search ..... 273/260, 261, 288, 262, 273/255

[56] References Cited

U.S. PATENT DOCUMENTS

| | | | |
|---|---|---|---|
| 499,041 | 6/1893 | Robbins | 273/261 |
| 621,799 | 3/1899 | Degges | 273/260 |
| 694,509 | 3/1902 | Winckfield | 273/261 |
| 3,627,324 | 12/1971 | Krepp | 273/260 |

FOREIGN PATENT DOCUMENTS

| | | | |
|---|---|---|---|
| 2269985 | 9/1976 | France | 273/260 |
| 112018 | 10/1925 | Switzerland | 273/260 |
| 14317 | of 1902 | United Kingdom | 273/262 |
| 1034030 | 6/1966 | United Kingdom | 273/288 |

*Primary Examiner*—Richard C. Pinkham
*Assistant Examiner*—R. Carl Moy
*Attorney, Agent, or Firm*—George W. T. Loo

[57] ABSTRACT

A chess type game played by two players on a playing board having 64 squares. Each player has four rectangular pieces called North, South, East, and West and a number of three different colored pins. Each piece has four directional vectors, an orientation indicator, and five pin openings in its head. Each piece can move in four directions as indicated by the vectors and the movement of each piece is different from the movement of another piece. Three basic play actions are score, restrict movement, and force movement. A game objective of scoring a specified number of time on the playing pieces of the opponent, scoring one time on opponent's special playing piece, or capturing the opponent's special playing piece is selected before play by the players. Special rules to accompany the selected game objective may also be selected before play by the players. The game may vary depending on the selected game objective and the special rules selected for the game by the players. Play continues until the selected game objective is met by one of the players or a mutual draw is declared by the players.

6 Claims, 20 Drawing Figures

STRATEGY GAME

BACKGROUND OF THE INVENTION

1. Field of the Invention

A strategy board game, such as chess, wherein a player makes his moves in view of the position of his opponent's pieces.

2. Description of the Prior Art

Chess is a game of skill played by two players on a board divided into 64 squares with two sets of 18 pieces. The players move alternately until one player wins by checkmating his opponent's king or until neither can do so and a stalemate results. Chess is a game which requires great skill and learning in order to play well. Chess is a game which takes a long time to play.

My invention is a chess type game that is designed to be played by a greater number of people than chess because less skill is required and the learning time is reduced. Moreover, the time of play is reduced and there is a greater variety of play objectives.

3. Prior Art Statement

Margetson, U.S. Pat. No. 3,608,904, Sept. 28, 1971, discloses a chess set comprising reversible pieces which are squares. Each piece has on one side the name and symbol of the piece and on the opposite side the name and move of the piece. Arrows indicate the direction of the move of each piece. Margetson does not teach the concept of providing vector indicia for eight possible directions of movement over a game board. Nor does it teach the use of an orientation line.

Grenier, Can. Pat. No. 973,221, Aug. 19, 1975, discloses a chess type game played by two players with eighteen pieces corresponding to figures of state, industry, citizens, etc. The aim is to move the pieces in a similar manner to chess pieces over the spaces which are decorated in two alternating colors. The pieces are roughly parallelepiped so that they may stand upright or rest on their sides. FIG. 10 shows a rectangular piece with a head and body connected by a neck, which is less in dimensions from that of the head or body. It represents the silhouette of a human.

Degges, U.S. Pat. No. 621,799, Mar. 28, 1899, discloses a game piece with a large hole at the center and four smaller holes surrounding the center hole. When a player secures four pins in a piece, a large captain pin is placed in the center hold and the piece is styled "Captain."

None of the above cited references anticipate my invention either singly or in combination. My invention is completely different from that of the cited references. My invention is played differently and with different objectives.

SUMMARY OF THE INVENTION

The invention relates to a chess type game played on a sixty-four square board by two players. Each player has a set of four different rectangular pieces and a number of three different colored pins. Each piece has four directional vectors, an orientation indicator, and five pin openings in its head. Players select a game objective and the applicable special rules before play. Players move alternately until the game objective is obtained or a draw is declared.

An object of this invention is to provide a strategy game which will require less skill to play than chess.

Another object of this invention is to provide a strategy game which has a variety of game objectives and special rules to go with the game objectives.

Still another object of this invention is to provide a strategy game which has three basic play actions: Score, restrict movement, and force movement.

Yet another object of this invention is to provide a strategy game which can be played by a greater number of people than chess.

Other objects, features and advantages of the present invention will be readily apparent from the following detailed description taken in connection with the accompanying drawings.

DESCRIPTION OF THE PREFERRED EMBODIMENT

Figure 1:
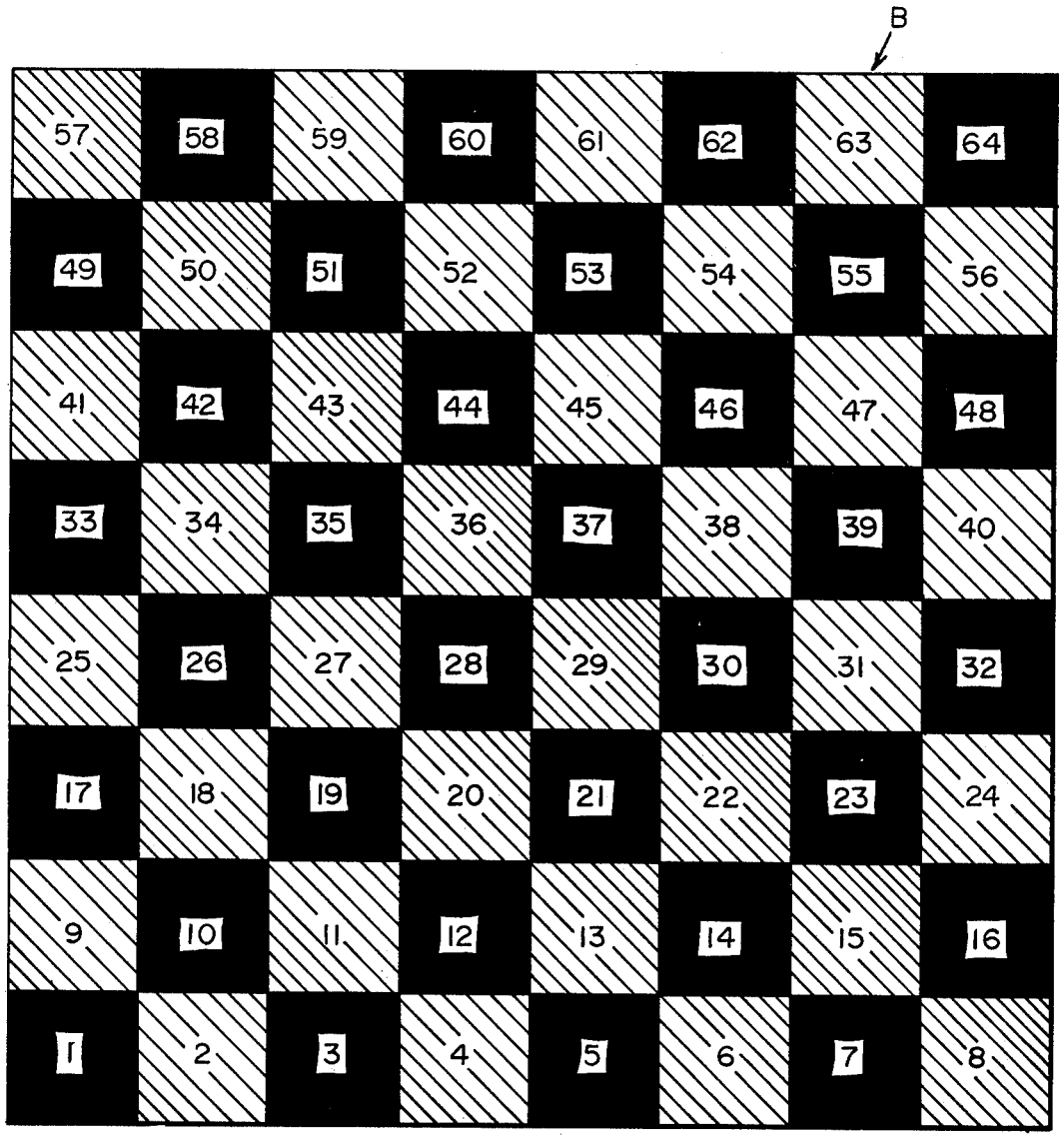
FIG. 1 is a plan view of a board divided into 8 rows of 8 squares each. The first row is numbered from 1 to 8 left to right and the rest of the board is numbered in ascending order in the same fashion.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings wherein like reference numerals or letters refer to like and corresponding parts throughout the several views, the preferred embodiment of the invention disclosed in FIGS. 1–6 inclusive includes a playing board B, playing pieces 70, 80, 90, 100, 120, 130, 140, and 150, and pins 110, 111, and 112.

In FIG. 1, playing board B is divided into 64 squares. The squares are from left to right across the board. Each square is marked so that each square has a fixed number in order to describe the playing piece movements. The squares of board B are colored alternatively black and green. However, any other colors may be used in combination.

Figure 2:
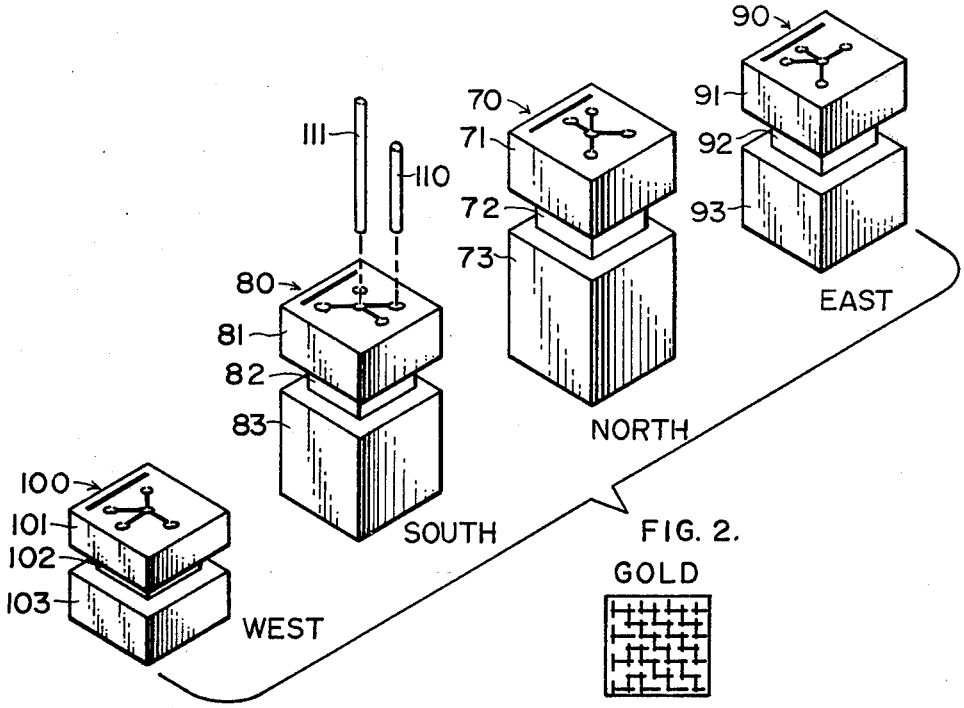
FIG. 2 is a perspective view of a set of the pieces.

In FIG. 2 is shown one set of playing pieces. Piece 70 has a head 71, a neck 72, and a body 73. Piece 80 has a head 81, a neck 82, and a body 83. Piece 90 has a head 91, a neck 92, and a body 93. Piece 100 has a head 101, a neck 102, and a body 103.

The head, neck and body of each piece are solid rectangles wherein the overall height of a piece is greater than the width; the head is equal to or greater in height than the neck; the height of the head is less than its length or width; the height of the neck is less than its length or width; the length or width of the neck is less than the length or width of the head or body; the head and body are of equal length and width; and the body is greater in height than the head or neck. It is also to be appreciated that the heights of the pieces may be varied by increasing the thickness of the heads, or the lengths of the necks, as well as the bodies as long as the limits of aforesaid contruction is maintained. The pieces are shaped to stimulate or give the impression of being mechanical men or robots. The generally rectagular configuration makes it easy to maintain alignment on the board and to move the pieces.

Each piece has a central opening, four lines radiating outward from the central opening, an opening at the end of each line, and an orientation line on its head. The radiating lines are in effect direction lines which indicate how a player can move each piece. They represent vector directions that each piece can move. The outer openings are the round head of the vectors and are directional ends of the vectors. The orientation line provides a means to maintain the direction of the piece on the board.

Figure 6:
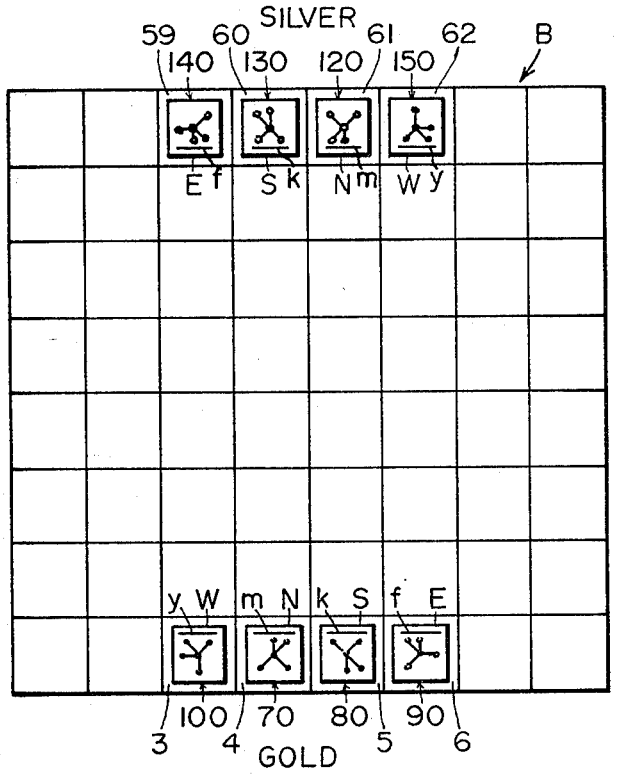
FIG. 6 is a plan view of the board with pieces in their starting positions.

In FIG. 6 are shown two sets of pieces. One set of pieces 70, 80, 90, and 100 are respectively identical to the other set of pieces 120, 130, 140, and 150 except that the former set is colored one color and the latter set is colored another color. I prefer to color the former set gold and the latter set silver. However, any other colors may be used to denote the respective side that the pieces belong to. For the sake of clarity, the pieces were not colored gold and silver in the drawings and numbers were used instead to designate the pieces. A legend is used in FIGS. 6 and 7 at each player's position to indicate the color.

Pieces 70 and 120 are called North, pieces 80 and 130 are called South, pieces 90 and 140 are called East, and pieces 100 and 150 are called West. North is the tallest, then South, then East, and then West.

Figure 3:
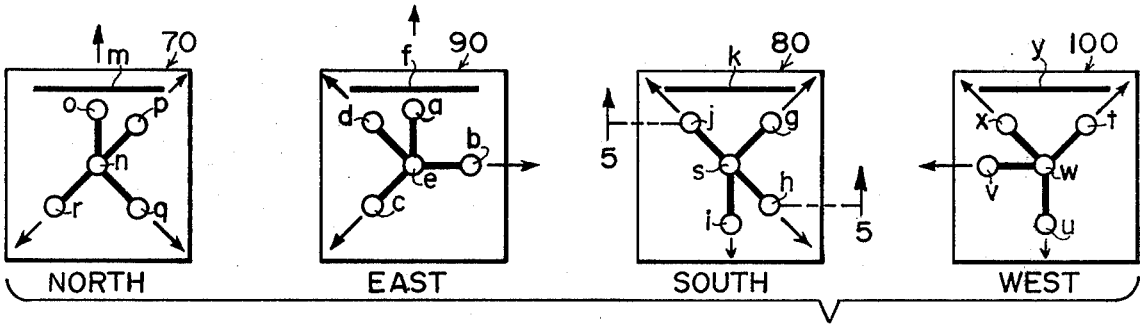
FIG. 3 is a plan view of the playing pieces showing the four vectors, orientation line, and five pin openings. Arrows illustrate how each piece is moved over the board.

In FIG. 3 is shown one set of playing pieces with visual indicating means. Piece 70 has a central opening n, four radiating lines, n-o, n-p, n-u, and n-r, four openings o, p, q, and r, and an orientation line m. Piece 80 has a central opening s, four radiating lines, s-g, s-h, s-i, and s-j, four openings, g, h, i, and j, and an orientation line k. Piece 90 has a central opening e, four radiating lines e-a, e-b, e-c, and e-d, four openings a, b, c, and d, and an orientation line f. Piece 100 has a central opening w, four radiating lines, w-t, w-u, w-v, and w-x, four openings t, u, v, and x, and an orientation line y. Arrows are shown around the pieces to indicate the direction of the radiating lines or vectors. However, arrows are not necessary if the players remember that the direction of each line starts from the central opening and proceeds outward.

Each piece can move in four out of a possible eight directions of movement over board B and the movement of each piece is different from the movement of another piece. The eight possible directions are up and down vertically, to the right or left horizontally, and four diagonal movements. The four diagonal movements in relation to up are 45° and 135° to right and left.

In FIG. 3, North can move up, 45° and 135° to the right and 135° to the left; South can move down, 45° and 135° to to the right and 45° to the left; East can move up, right horizontally, and 45° and 135° to the left; West can move down, left horizontally, and 45° to the right or left. It should be appreciated that these directions will change if the pieces are rotated for game play.

A plurality of different colored pins 110, 111, and 112 are provided for use in the game under certain circumstances of play. They are to be inserted into the central opening and the four outer openings in each piece when a player has achieved a certain goal against his opponent in the playing of the game.

Figure 4:
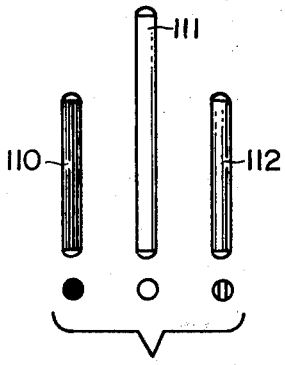
FIG. 4 is a front view of the three different colored pins.
Figure 5:
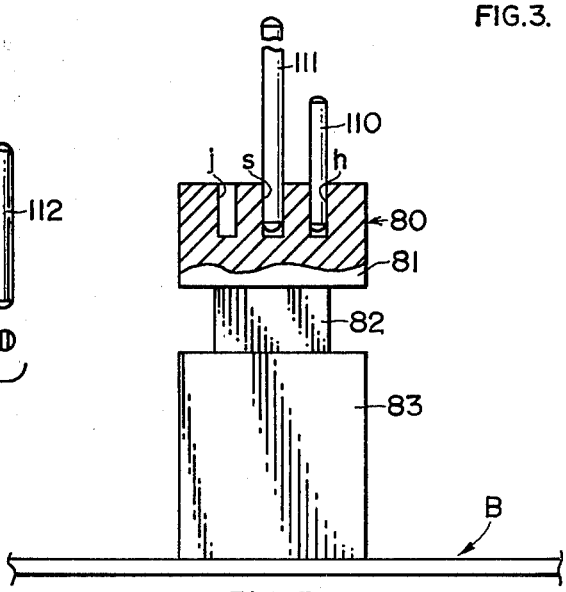
FIG. 5 is a sectional view of the head of piece 80 looking in the direction indicated by the arrows of line 5—5 of FIG. 3 with pins 110 and 111 placed in openings h and s to illustrate pin placement.

In FIG. 4 are shown three pins 110, 111, and 112. Pin 110 is colored black, pin 111 is colored white, and pin 112 is colored red. However, any other colors may be used if desired. Pins 110 and 112 are of the same length while pin 111 is longer. Pin 110 is used for scoring; pin 111 is used to designate a special playing piece (SPP); and pin 112 is used to restrict movement. Pins 110 and 112 may be placed in any opening while pin 111 may be placed only in the central opening. FIG. 5 shows pin 110 and pin 111 in head 81. There are 24 pins 110, 2 pins 111, and 8 pins 112. Each player gets one half of each type of pins.

This is a board game which may be played in different ways depending on which game objective is selected. The game construction is divided into basic and special construction. Basic construction applies to all game objectives of play. Special construction is designated for a specific game objective.

Figure 7:
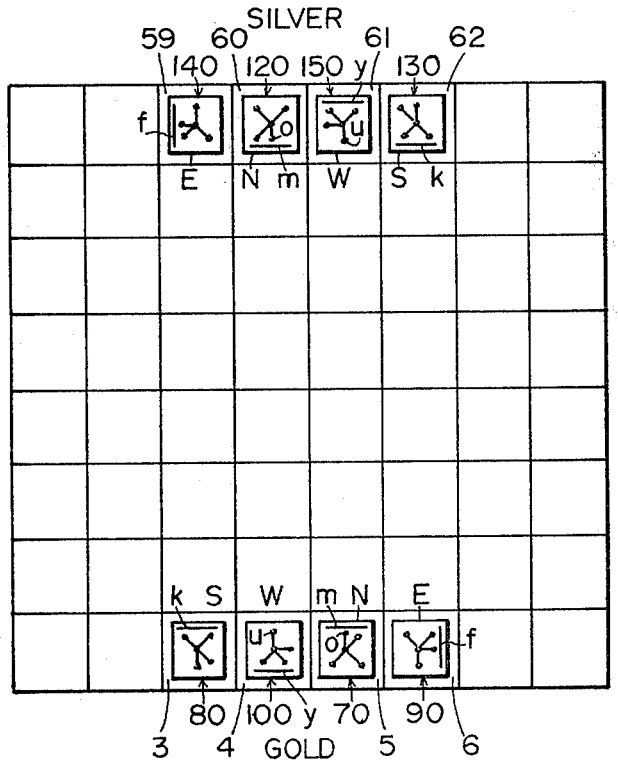
FIG. 7 is a plan view of the board with pieces in starting positions with an alternate alignment.

The following basic construction applies to all game objectives of play: (1) A light corner square on board B is placed at the player's right hand. (2) The row closest to each player is called the "home row". (3) The first 4 rows closest to each player are called "home territory" for player. (4) A square must be vacant on board B for a piece to be moved to it. (5) Jumping over another piece is not allowed. (6) Moving distance is limited by a player's choice, interference of a piece, board boundary, or game construction. (7) To begin play, pieces are positioned identically, in any order on squares 3, 4, 5, and 6 for pieces 70, 80, 90, and 100 and an squares 59, 60, 61, and 62 for pieces 120, 130, 140, and 150. Pieces may be also individually rotated in 90° increments with both set maintaining identity. FIGS. 6 and 7 are examples of positions to begin play. (8) A call of a coin or other method of chance is used to choose which player shall select the starting position of the pieces. (9) A turn at play is made by a choice of movement of one of the four pieces from one square to another square on the board in one of the four directions visually displayed by the vectors on the piece. (10) The player not selecting the starting position shall move first. (11) The first move for each player is limited to his home territory, the first four rows. (12) Three basic play actions are score, restrict movement, and force movement.

Figure 8:
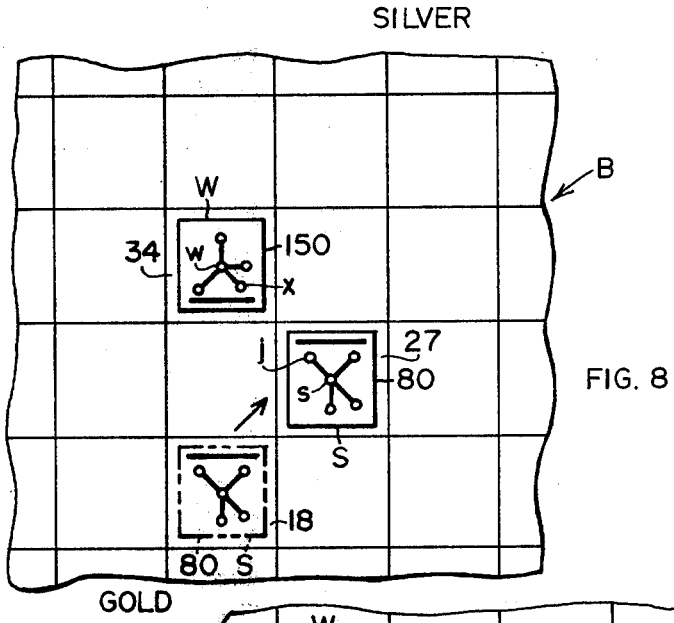
FIG. 8 is an illustration of board play on how to score.

A score is executed, as shown in FIG. 8, when piece 80 is moved from square 18 to square 27 such that piece 80 is at a position next to piece 150 and vectors s-j and w-x are pointed towards each other. The conditions for scoring are as follows: (1) A piece is moved to another square. (2) The piece is adjacent to an opponent's piece and one vector of the piece is pointing towards one vector of the opponent's piece. (3) The scoring position must be identified during the immediate turn at play. (4) A pin 110 is inserted in an opening of the opponent's piece to register the score. (5) A piece that is scored upon must move to another square on the next turn at play. (6) A score may be made on more than one piece during a turn at play. The player scoring has the choice of selecting which piece must be moved.

Figure 9:
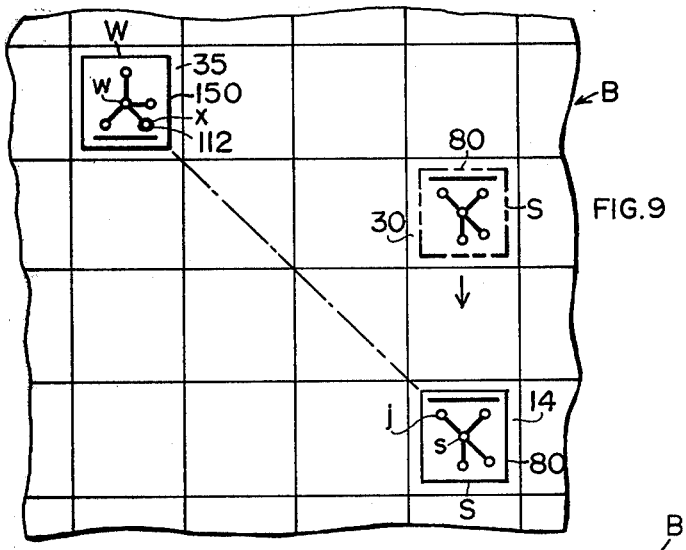
FIG. 9 is an illustration of board play on how to restrict movement of a piece.

A restrict movement is executed, as shown in FIG. 9, when a piece 80 is moved from square 30 to square 14 such that piece 80 is at a position not next to piece 150 and vectors s-j and w-x are pointed at each other. Piece 150 is restricted from advancing towards piece 80 along the dash line between openings x and j. A pin 112 is inserted in an opening of piece 150 to mark the restriction. The conditions for restricted movement are as follows: (1) A piece is moved to another square. (2) The piece is not adjacent to an opponent's piece and one vector of the piece is pointing towards one vector of the opponent's piece. (3) The restrict movement must be identified during the immediate turn at play. (4) A pin 112 is inserted in appropriate opponent's opening to mark the restriction. If there is a conflict of pins, the scoring pin may be moved to another opening. (5) Failure to identify the restrict movement during the immediate turn at play will allow a restrict movement position to be registered by either player during their subsequent turns at play. This is in addition to a regular turn at play. (6) A new restrict movement position can be established if either piece is moved from the original restrict movement alignment. (7) A restrict movement position can be called for each position identified during a turn at play. (8) The pin is removed if a score is registered or the restrict movement position is broken-off or countered.

Figure 10:
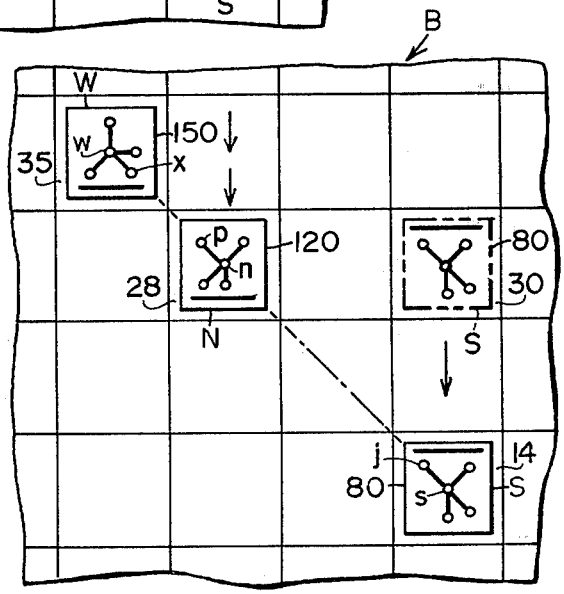
FIG. 10 is an illustration of board play on how to break-off a restrict movement position.

If a score is registered, a score pin is inserted. The restrict movement position is broken-off, as shown in FIG. 10, when piece 120 is moved to square 28 such that it is not adjacent to piece 80 and there are no vectors in piece 80 and piece 120 pointing towards each other. When the restrict movement position is broken-off, pin 112 is removed from the appropriate opening in piece 150, the restricted piece.

Figure 11:
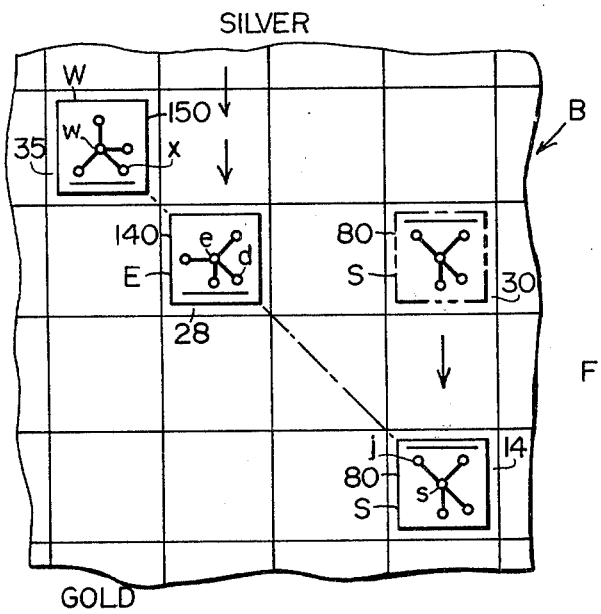
FIG. 11 is an illustration of board play on how to counter a restrict movement position.

The restrict movement position is countered, as shown in FIG. 11, when piece 140 is moved to square 28 such that it is not adjacent to piece 80 and vectors e-d and s-j are pointed at each other. A counter position cancels the original restrict movement position and in itself becomes another origination of a restrict movement position. Piece 80 is restricted in movement towards piece 140 and a pin 112 is placed in opening j to register the restriction. Pin 112 is removed from opening x in piece 150 to end the restriction on piece 150.

In FIG. 7, a game opening setup, pieces 100 and 120 and pieces 70 and 150 are in a restrict movement alignment. They may not advance vertically toward each other. A pin 112 is inserted in opening u of pieces 100 and 150 and in opening o of pieces 70 and 120 until the restrict movement alignment is broken-off or countered.

Figure 12:
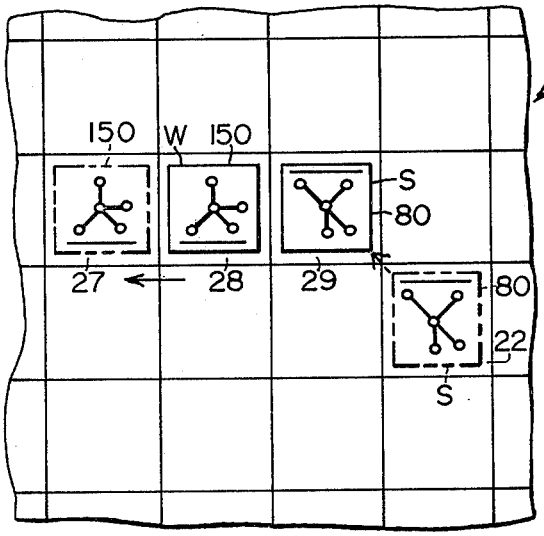
FIG. 12 is an illustration of board play on how to force movement of a piece.

A force movement is taken, as shown in FIG. 12, when piece 80 is moved from square 22 to square 29 and is at a position next to piece 150 and no vectors of the two pieces are pointing at each other. Piece 80 is in a force movement position on piece 150. The force movement action is executed by moving piece 150 one square opposite the force movement position, from square 28 to square 27.

The conditions of a force movement position are as follows: (1) A piece must be moved to another square to cause a force movement. (2) The force movement position must be identified during the immediate turn at play to force the move. (3) The piece forced to move can not be used to score or register a force movement position on another piece. (4) If a force movement position is taken on two or more pieces during a turn at play, only one piece is forced to move. The player initiating the force movement position shall choose which piece is to be moved. (5) The player initiating the force movement may call any restrict movement positions that occur as a result of the force movement. (6) If a force movement position is executed and the piece forced to move is unable to move, no movement is required.

Special construction only applies to the game objective when specified. They include: (1) Removing a playing direction from play on a piece as part of a score. (2) Removing a piece from board B that has 5 scores on it. (3) Limiting moving distance of a piece that has 3 scores on it to 2 squares. (4) Selecting the amount of the scoring objective. (5) Selecting a special playing piece (SPP) with or without special force movement position.

Figure 13:
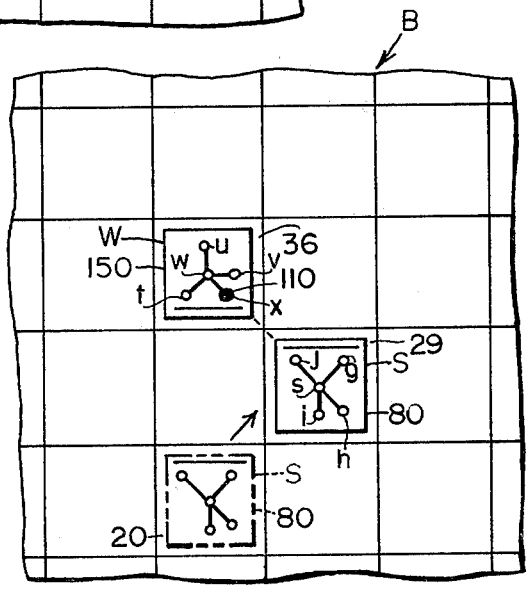
FIG. 13 is an illustration of board play on how to remove a direction from play on a piece.

A playing direction w-x can be removed from play as part of a score as shown in FIG. 13 by placing a pin 110 in opening x to mark a score. During subsequent turns at play, pin 110 may be shifted to other openings v, u, or t if direction of play w-v, w-u, or w-t have not previously been removed from play or a pin 110 shifted to it. This shift of pin 110 from one opening to another counts as a turn at play. The direction of play that pin 110 was moved to is removed from play as a result of the shift of pin 110. A direction that has been removed from play is treated the same as a force movement position in subsequent turns at play. A direction that becomes free during the turn at play by the shifting of pin 110 can be used to call a restrict movement position. A piece that has all directions of play removed from play stays in place on board B.

A playing piece may be selected as a special playing piece (SPP) by the player who selects the starting position of the pieces. The SPP is identical for both players. The SPP is marked by putting a pin 111 in the central opening as shown in FIGS. 2 and 5. This piece may either be scored upon or captured. Captured is achieved when the SPP is continuously in contact from either a score, restrict movement, or force movement position. The SPP is played the same as the other pieces except that it must always move out of a score, restrict movement, or force movement position.

In game options when the SPP is chosen as an objective of play, an optional special force movement may be selected for use only with the SPP. The basic force movement position is used but the force movement of the SPP is varied according to the number of squares moved to approach the force movement position. See FIGS. 14 to 20.

Figure 14:
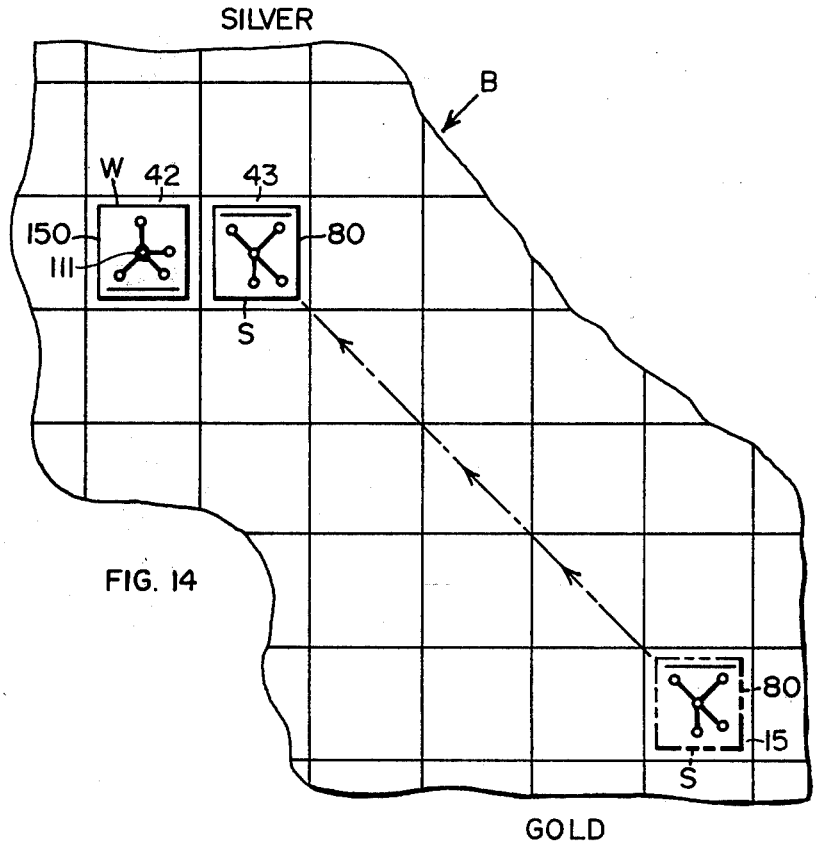
FIGS. 14 to 20 are a series of illustrations of board play on how to force movement of the special playing piece, depending on the amount of squares the piece has to move towards the special playing piece.
Figure 15:
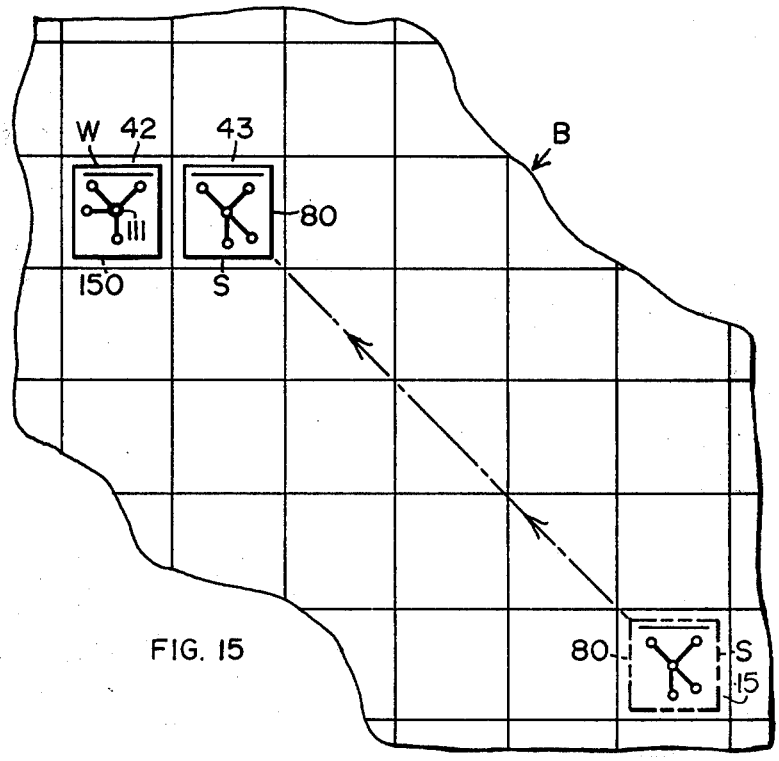

The first force movement position is defined by the approach of 4 or more squares. In FIG. 14, piece 80 is moved 4 squares from square 15 to square 43 to a force movement position on piece 150, the designated SPP. Piece 150 is forced to rotate 180° to a position shown in FIG. 15.

Figure 16:
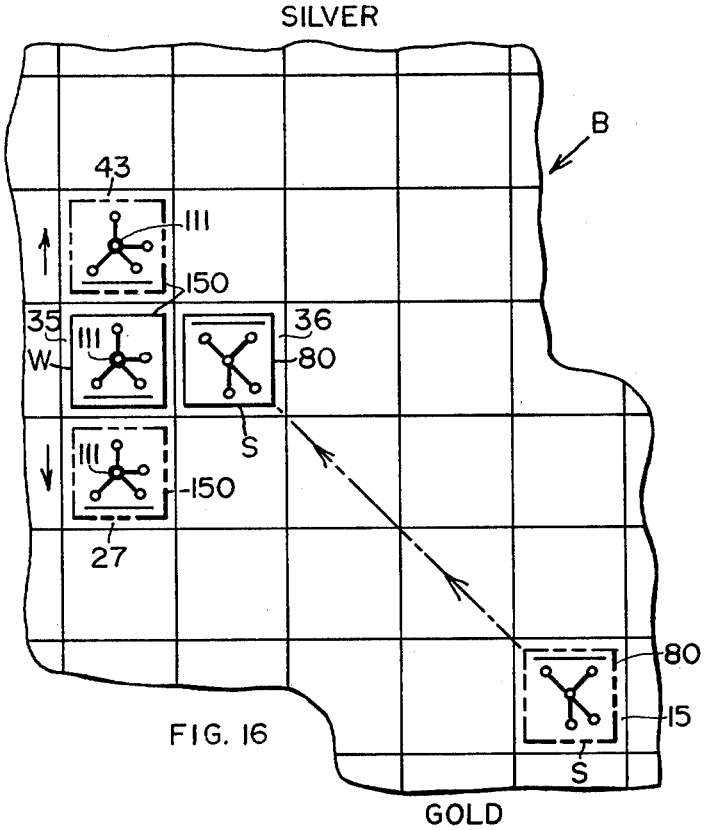

The second force movement position is defined by the approach of 3 squares. In FIG. 16, piece 80 is moved 3 squares from square 15 to square 36 to a force movement position on piece 150, the designated SPP. Piece 150 is forced to move 1 square on a column from square 35 to either square 27 or 43. The choice of the force movement is selected by player of piece 80.

Figure 17:
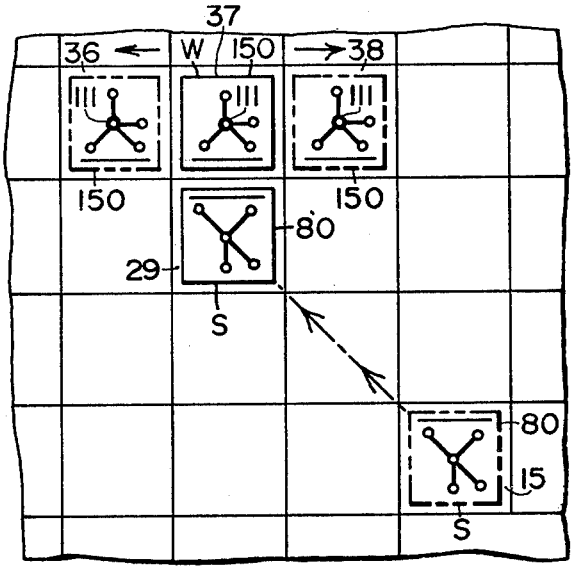

The third force movement is defined by the approach of 2 squares. In FIG. 17, piece 80 is moved 2 squares from square 15 to square 29 to a force movement position on piece 150, the designated SPP. Piece 150 is forced to move 1 square on a row from square 37 to either square 36 or 38. The choice of the force movement is selected by player of piece 80.

Figure 18:
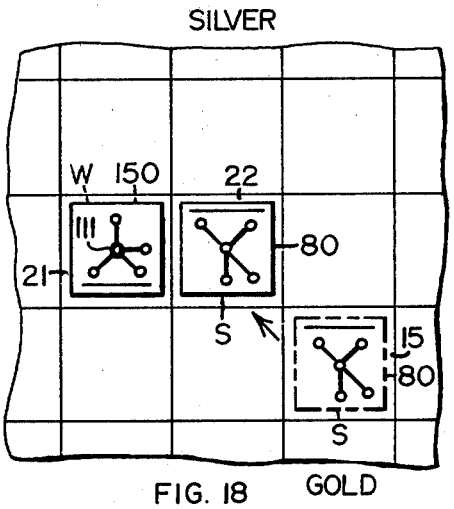
Figure 19:
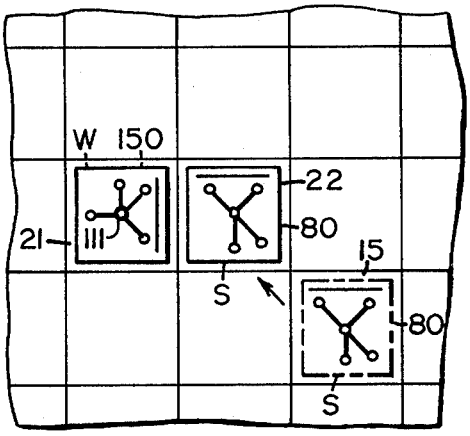
Figure 20:
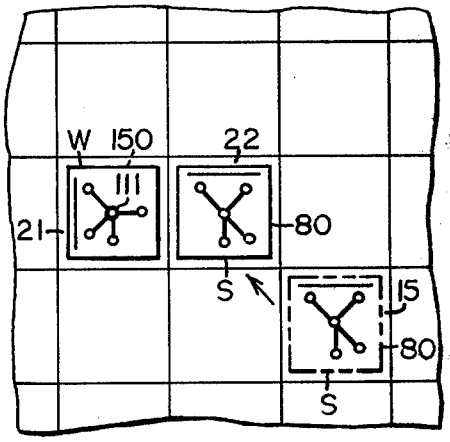

The fourth force movement position is defined by the approach of 1 square. In FIG. 18, piece 80 is moved 1 square from square 15 to square 22 to a force movement position on piece 150, the designated SPP. Piece 150 is forced to rotate 90° to the left or right, as shown by FIGS. 19 and 20, respectively. The choice of the left or right rotation is made by the player of piece 80.

If the choice of force movement is restricted by board space or pieces, the SPP being forced to move is moved to the only available square. If no square is available, the SPP is captured.

The game objectives are any of the following: (1) Score 10 times on the pieces of the opponent; (2) Score 1 time on opponent's SPP; or (3) Capture opponent's SPP. The game objective is selected by the players prior to the start of play.

Special construction may be selected with each game objective. For the first game objective, the special construction selected may be to remove pieces after 5 scores and to limit moving distance of a piece to 2 squares for each turn at play after 3 scores. For the second game objective, the special construction selected may be to remove playing directions from play as part of a score. For the third game objective, the special construction selected may be to have special force movement position, limiting moving distance of a piece except SPP to 2 squares for each turn at play after 3 scores, and removing a playing direction from play on a piece as part of a score. The kind and amount of special construction selected for use with a game objective will be determined by the players prior to the start of play, after the selection of the game objective.

Although but a single embodiment of the invention has been disclosed and described herein, it is obvious that many changes may be made in the size, shape, arrangements and detail of the various elements of the invention without departing from the scope of the novel concepts of the present invention.

I claim as my invention:

1. A strategy game comprising a playing board with 64 squares, 2 sets of playing pieces, wherein each set of playing pieces includes four rectangular shaped playing pieces of varying heights, each piece has a head, a neck, and a body, in the head of each piece are a central opening, four lines radiating outwardly from the central opening, an opening at the end of each line, and an orientation line, the four lines are vectors which indicate how the piece may be moved on the playing board, the movement of each piece differs from the movement of every other piece, means to register a score on a playing piece, means to designate a special playing piece, and means to mark a restriction of movement of the playing pieces.

2. The strategy game of claim 1, wherein the overall height of a playing piece is greater than the width, the head is equal to or greater in height than the neck, the height of the head is less than its length or width, the height of the neck is less than its length or width, the length or width of the neck is less than the length or width of the head or body, the head and body are of equal length and width, and the body is greater in height than the head or neck.

3. The strategy game of claim 1, wherein the 2 sets of playing pieces are colored differently and the playing pieces are shaped to stimulate or give the impression of being mechanical men or robots.

4. The strategy game of claim 1, wherein the means to register a score on a playing piece, means to designate a special playing piece, and means to mark a restriction of movement of the playing pieces are 2 sets of three different colored pins of a predetermined number, which are used with the central opening and the end of line openings in the pieces to perform the specified functions at predetermined occasions.

5. The strategy game of claim 4, wherein the pin used to designate a special playing piece is of a greater length than the other pins.

6. The strategy game of claim 5, wherein the 2 sets of playing pieces are colored differently and the playing pieces are shaped to stimulate or give the impression of being mechanical men or robots.

* * * * *